United States Patent [19]

Shimoyama

[11] Patent Number: 4,867,586

[45] Date of Patent: Sep. 19, 1989

[54] INK RIBBON CASSETTE AND LOADING MECHANISM THEREFOR

[75] Inventor: Noboru Shimoyama, Yokohama, Japan

[73] Assignee: Canon Kabushiki Kaisha, Tokyo, Japan

[21] Appl. No.: 170,051

[22] Filed: Mar. 16, 1988

Related U.S. Application Data

[63] Continuation of Ser. No. 814,773, Dec. 30, 1985, abandoned.

[30] Foreign Application Priority Data

Dec. 31, 1984 [JP] Japan ..... 59-281437

[51] Int. Cl.[4] ..... B41J 32/00

[52] U.S. Cl. ..... 400/208; 400/228

[58] Field of Search ..... 400/194, 195, 196, 196.1, 400/207, 208, 208.1, 228, 236

[56] References Cited

U.S. PATENT DOCUMENTS

| | | | |
|---|---|---|---|
| 3,877,561 | 4/1975 | Guerrini et al. | 400/208 |
| 3,918,569 | 11/1975 | Parker | 400/196 |
| 4,339,210 | 7/1982 | Craft et al. | 400/208 |
| 4,396,305 | 8/1983 | Shattuck et al. | 400/208 |
| 4,407,593 | 10/1983 | Haftmann | 400/208 |
| 4,494,886 | 1/1985 | Kondo et al. | 400/208 |
| 4,558,965 | 12/1985 | Ueda et al. | 400/208 X |
| 4,568,210 | 2/1986 | Privitera | 400/208 X |
| 4,615,631 | 10/1986 | Ueda et al. | 400/208 X |
| 4,623,272 | 11/1986 | Kondo | 400/208 |
| 4,730,780 | 3/1988 | Shimoyama | 400/208 X |

FOREIGN PATENT DOCUMENTS

| | | | |
|---|---|---|---|
| 0058847 | 12/1983 | European Pat. Off. . | |
| 3106958 | 10/1982 | Fed. Rep. of Germany . | |
| 2554391 | 5/1985 | France . | |
| 56-21884 | 2/1981 | Japan . | |
| 27385 | 3/1981 | Japan | 400/212 |
| 219082 | 12/1983 | Japan | 400/208 |

OTHER PUBLICATIONS

IBM Technical Disclosure Bulletin, vol. 17, No. 4, New York, U.S. Sep. 1974, pp. 1118–1119, H. L. Carpenter.

*Primary Examiner*—Charles Pearson

*Attorney, Agent, or Firm*—Fitzpatrick, Cella, Harper & Scinto

[57] ABSTRACT

An ink ribbon cassette with two projecting arms between which an ink ribbon is held exposed for printing. The cassette has a positioning slit in one of the arms, extended perpendicular to the running direction of the ink ribbon, and two side fixing projections. The former fixes the cassette in the running direction of the ribbon while the latter fix the cassette in the vertical direction, thus securing improved mounting of the cassette and preventing undesirable movement of the cassette.

7 Claims, 3 Drawing Sheets

INK RIBBON CASSETTE AND LOADING MECHANISM THEREFOR

This application is a continuation of application Ser. No. 814,773 filed 12/30/85 now abandoned.

BACKGROUND OF THE INVENTION

1. Field of the Invention

The present invention relates to an ink ribbon cassette in which an internally contained ink ribbon is guided by a guide arm and exposed to the experior thereof, and to a loading mechanism therefor.

2. Description of the Prior Art

Impact printers often employ so-called use ink ribbon which loses ink in an area once hit by a type letter. Such an ink ribbon is usually contained in a cassette, and is advanced by a minimum pitch since economy in use of the ribbon is desired recently. However, the advancement with such a minimum pitch may cause defective printing since the area in which the ink is already lost may be hit by the type letter again if the ribbon is displaced by unexpected vibration during a printing operation.

SUMMARY OF THE INVENTION

An object of the present invention is to provide an ink ribbon cassette which can be loaded with precise positioning.

Another object of the present invention is to enable more precise positioning and loading of an ink ribbon cassette.

Still another object of the present invention is to enablew smooth positioning and loading of an ink ribbon cassette.

Still another object of the present invention is to prevent movement of an ink ribbon cassette caused by operations of a ribbon advancing member.

Still another object of the present invention is to increase the supporting force for an ink ribbon cassette.

Still another object of the present invention is to provide a loading mechanism for an ink ribbon cassette, which enables the ink ribbon cassette to be loaded in an exact position with a simple structure.

Still another object of the present invention is to achieve more precise positioning of an ink ribbon cassette.

Still other objects of the present invention will become fully apparent from the following description.

BRIEF DESCRIPTION OF THE DRAWINGS

The attached drawings illustrate an embodiment of the present invention, wherein.

DETAILED DESCRIPTION OF THE PREFERRED EMBODIMENTS

Figure 1:
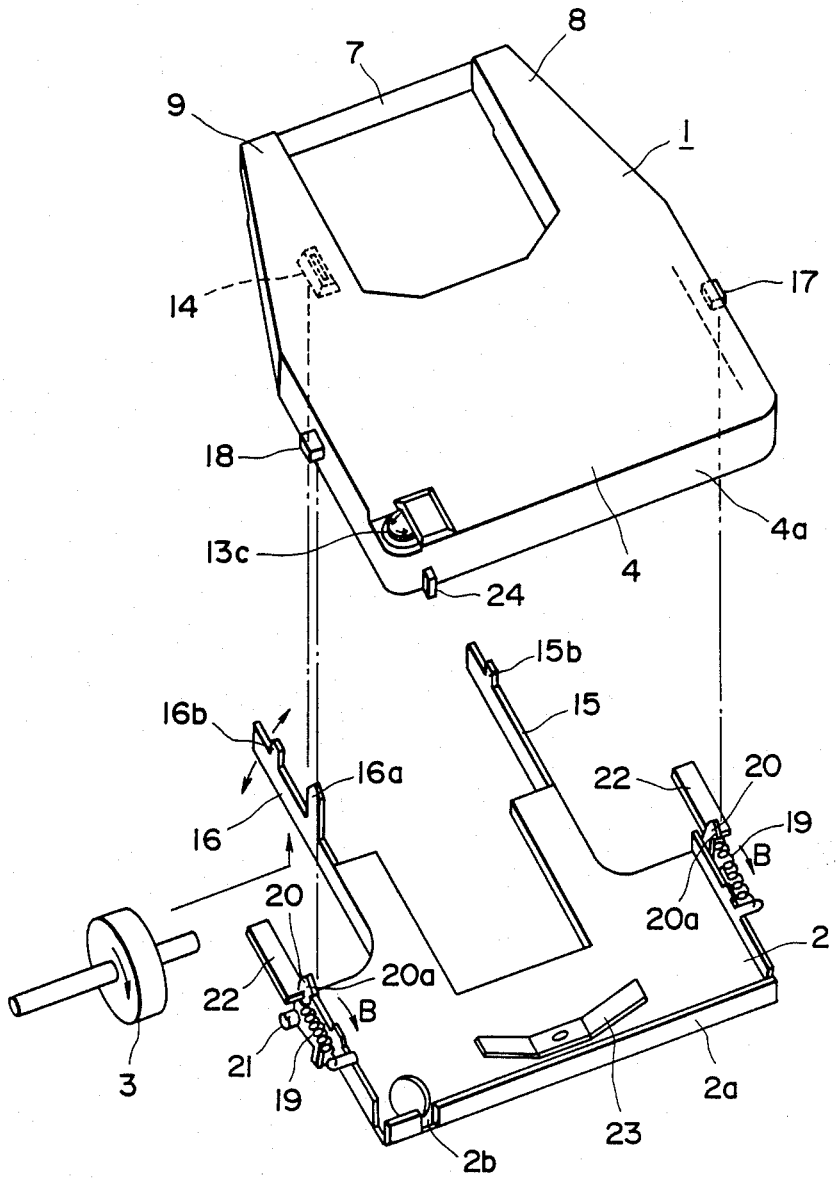
FIG. 1 is a perspective view of an entire cassette ane a portion of a mounting mechanism for it.

FIG. 1 illustrates an embodiment of the present invention, wherein an ink ribbon cassette 1 is loaded on a pivotable plate 2, constituting a support for the ink ribbon cassette, fixed on a carriage of an unrepresented printer. Under the pivotable plate 2 there is provided an eccentric cam 3, of which rotation causes vertical pivotting of the plate 2, thus inducing integral pivotting of the ink ribbon cassette loaded on said pivotable plate.

Figure 2:
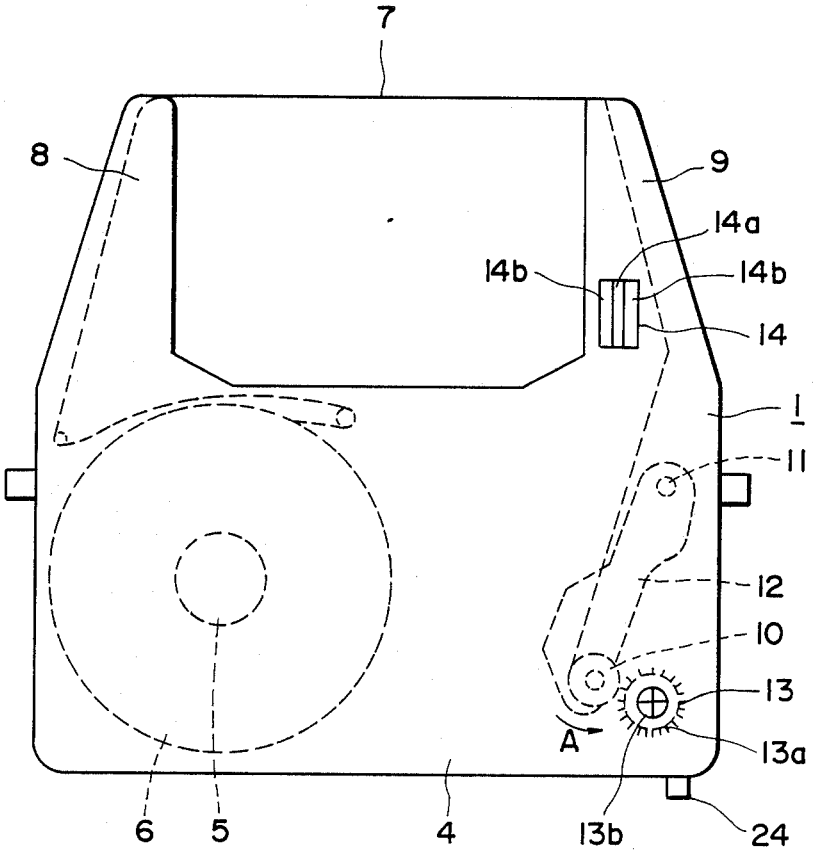
FIG. 2 is a bottom plan view of the cassette.
Figure 2A:
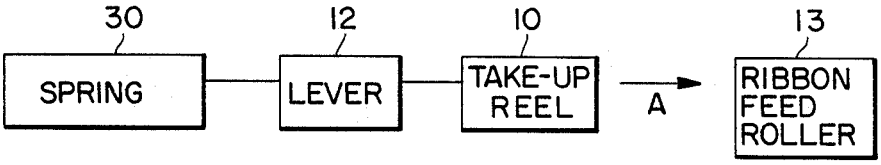
FIG. 2A is a block diagram showing a spring biasing a take-up reel toward a ribbon feed roller.

As shown in FIG. 2, in a main body 4 of the ink ribbon cassette 1, there are provided a feed spool 6 wound on a reel 5, and a take-up reel 10 for winding a ribbon 7 which is drawn from the spool 6, guided to the exterior from the front end of a guide arm 8 and then to the interior from the front end of another guide arm 9. The take-up reel 10 is rotatably supported at an end of a lever 12 which is rotatable about a pin 11, and is biased in a direction A by a spring 30, toward a ribbon feed roller 13, as illustrated in FIG. 2A. On the periphery of said ribbon feed roller 13 there are provided pins **13*a* to wind the ribbon on the reel 10 by contacting the ribbon. The ribbon feed roller 13 is driven by an unrepresented driving claw protruding from the carriage and engaging with a cross-shaped groove 13*b* of the ribbon feed roller 13. The ribbon feed roller 13 is provided at the lower right corner, in FIG. 2, of the main body 4. The take-up reel 10 becomes larger as it takes up the ribbon, and the lever 12 is therefore moved in a direction opposite to A, so that the take-up reel does not touch the wall of the cassette. The positioning of the ribbon feed roller 13 at the lower right corner allows maximizing the amount of ribbon to be taken up. On the lower face of the arm 9 there is formed a positioning slit 14, which is parallel to the direction of the arm 9 and is perpendicular to the advancing direction of the ribbon between the arms 8, 9. In the slit 14, a central slit recess 14*a* formed inside of the bottom face of the main body 4 is connected to the bottom face by slant faces 14*b*, and a positioning flat protrusion 16*a* projecting from a support arm 16 is guided by the slant faces 14*b* and fitted in the slit recess 14*a* to support the cassette. As shown in FIG. 1, support arms 15, 16 protrude from the pivotable plate 2, corresponding to the arms 8, 9 of the ink ribbon cassette, and projections 15*b*, 16*b* support the bottom face of the arms 8, 9**.

On both lateral faces of the cassette main body 4, there are provided flat pins 17, 18 for fixing the cassette to the pivotable plate 2. The pins 17, 18 are rectangular in cross section perpendicular to the projecting direction thereof, and are provided with a tapered face such as **18*a* shown in FIG. 3, for achieving smooth engagement in portions corresponding to fixing pawls 20. In the positions corresponding to the pins 17, 18, the pivotable plate 2 is provided with fixing pawls 20 rotatably biased by springs 19 in a direction B about shafts 21. Each of said fixing pawls 20 is provided with a push lever 22, which, when depressed, rotates the fixing pawl 20 in a direction opposite to B, thus disengaging the pawl 20 from the pin 17 or 18**.

The ink ribbon cassette 1 can be mounted on the pivotable plate 2 by merely pressing the cassette 1 against the pivotable plate 2. The fixing pawls 20, of which slant faces **20*a* are pressed by the pins 17, 18, rotate in a direction opposite to B against the force of the springs 19, and, when the pins 17, 18 pass, again rotate in the direction B to engage with said pins 17, 18. The springs 19 of the fixing pawls 20 press the cassette against the pivotable plate, and the rear end 4*a* of the cassette main body 4 against a rear bent portion 2*a* of the pivotable plate 2, thus defining the position of the cassette in the front-rear direction. On the upper face of the pivotable plate 2 there is provided a plate spring 23 to press the cassette main body 4 upward. The spring 23 firmly presses the pins 17, 18 against the fixing pawls 20** and generates a moment to engage the lower face of the arms 8, 9 with the projections 15*b*, 16*b* of the support arms 15, 16 as explained before. In this manner the cassette position in the vertical direction is defined.

In a state where the cassette is mounted on the pivotable plate 2, the flat protrusion 16*a* of the support arm 16 snugly engages with the slit recess 14*a*, thus avoiding the movement of the cassette 1 in the lateral direction perpendicular to the arms 8, 9.

Also in the mounted state of the cassette, a rear pin 24, protruding opposite to the arm 9 at the left-hand end, in FIG. 1, of the rear end 4*a* of the cassette main body 4, engages with a positioning notch 2*b* formed in the rear bent portion 2*a* of the pivotable plate.

The rear pin 24 prohibits the movement of the cassette main body 4 at the rear end thereof with respect to the pivotable plate 2, and improves the positioning accuracy of the cassette in cooperation with the slit 14.

The ribbon feed roller 13 is provided with an integral manual feed knob 13*c* exposed from the upper face of the cassette, thus allowing take-up of the slack of the ribbon 7.

The ribbon feed roller 13, which is rotated by the driving claw provided on the carriage as explained before, is scarcely affected by the driving force thereof because of the position of the roller close to the rear pin 24 on a line connecting the rear pin 24 and the slit 14, thus minimizing the movement of the ribbon cassette resulting from the ribbon advancement.

Figure 3:
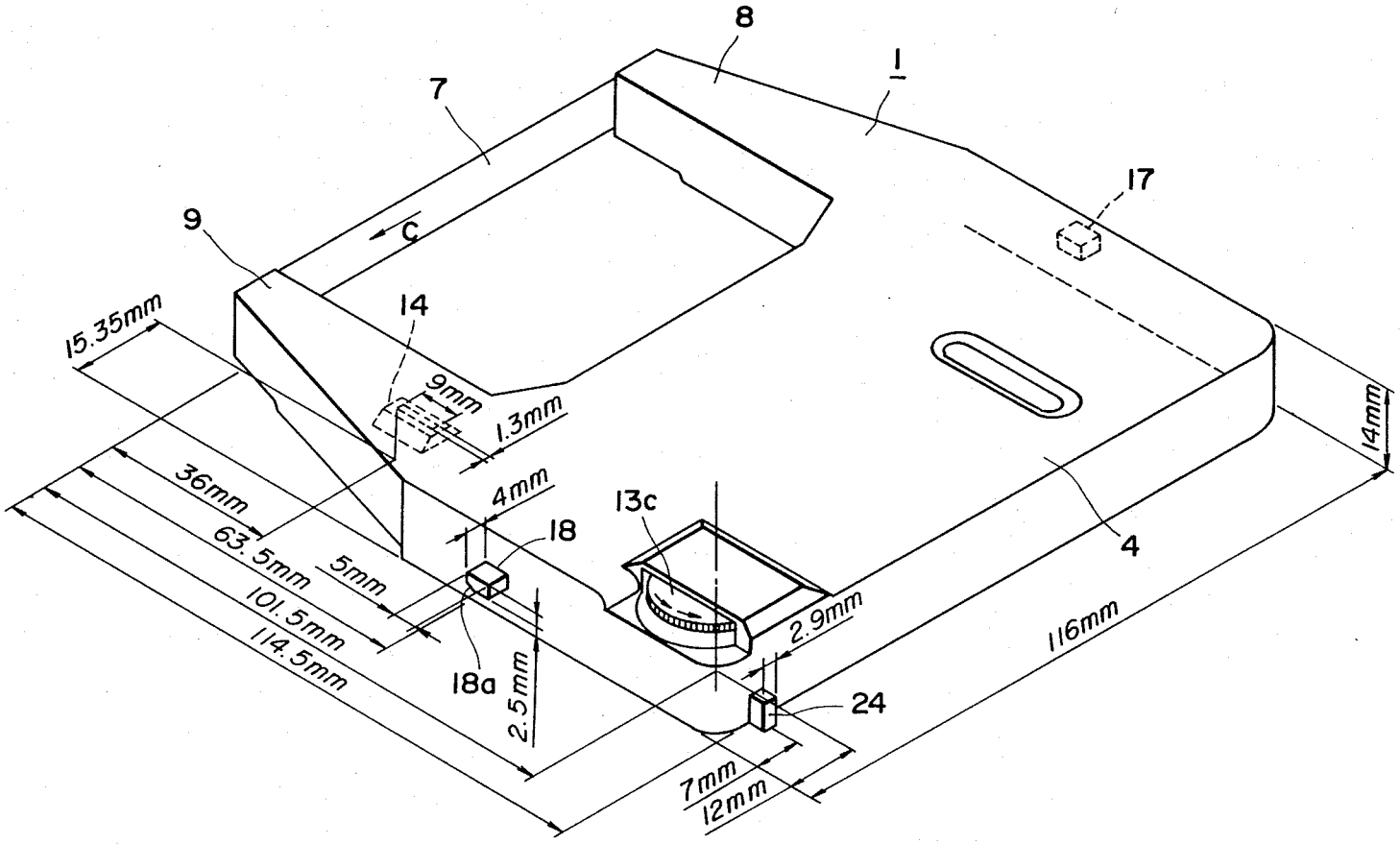
FIG. 3 is a perspective view indicating preferred dimensions of the cassette.

FIG. 3 shows preferred dimensions of the ink ribbon cassette of the present embodiment, but it will be readily understood that the dimensions can be modified.

The above-explained embodiment has the following advantages.

First, the cassette 1 does not move in the advancing direction C of the exposed ink ribbon since the positioning slit 14 is provided in the arm 9 which is close to the printing position of the ink ribbon. The movement of the cassette 1 in direction C is further reduced by the fact that the slit recess 14*a* extends along the arm 9 and engages with the flat protrusion 16*a*.

Upon molding the cassette, the slit 14 and the rear pin 24 can have a very high relative positional precision, since the rear pin 24 is placed closest to the slit 14 at the rear end of the cassette main body 4. Consequently, the mounting precision of the cassette can be significantly improved.

Also, the fixing pins 17, 18 provided on both lateral faces of the main body 4 have a flat form, allowing engagement with the fixing pawls 20 through large areas. Consequently, the cassette 1 can be firmly fixed to the pivotable plate 2.

It is to be understood that the present invention is not limited to the foregoing embodiment. For example, the ink ribbon is not limited to one-time ink ribbon, but can be a correctable ribbon or any other ribbons.

What is claimed is:

1. An ink ribbon cassette, comprising:

a cassette body having a rear face, opposing side faces, a top face, a bottom face, a pair of guide arms each extending in generally parallel configuration to an extreme of said guide arms;

an ink ribbon contained in said cassette body, said cassette body and said guide arms guiding said ink ribbon therein with a portion of said ink ribbon extending between said extremes of said guide arms to expose said portion to the exterior of said cassette body for printing;

a ribbon feeding member comprising a rotation shaft extending between the top face and the bottom face of said cassette body, the ribbon feeding member being rotated by power transmitted from the exterior thereof and having at its periphery an engaging portion which engages said ink ribbon;

a take-up spool for taking up said ink ribbon;

a swing member on end of which is rotatably supported on a rotation shaft within said cassette body and the other end of which is free and rotatably supports said take-up spool;

biasing means for imparting a rotation force to said swing member so that said take-up spool is urged against said ribbon feeding member;

a pair of inclined surfaces formed in said bottom face of said cassette body, inclined with respect to said bottom face, and terminating in a positioning slit extending in a direction essentially perpendicular to the direction of said ink ribbon portion extending between said extremes of said guide arms and essentially parallel to said guide arms;

a fixing projection formed on each opposing side of said cassette body; and a positioning projection formed on said rear face of said cassette body opposite one of said guide arms; wherein said positioning projection is provided opposite one guide arm associated with said positioning slit, and wherein said positioning slit, said rotation shaft of the ribbon feeding member, and said positioning projection are arranged substantially in a straight line.

2. An ink ribbon cassette according to claim 1, wherein each of said fixing projections has a substantially rectangular cross sectional shape in a plane perpendicular to the direction of projection thereof and including a tapered surface at one corner thereof.

3. An ink ribbon cassette system, comprising:

an ink ribbon cassette, including:

a cassette body having a rear face, opposing side faces, a top face, a bottom face, and a pair of guide arms each extending in a generally parallel configuration to an extreme of said guide arms;

an ink ribbon contained in said cassette body, said cassette body and said guide arms guiding said ink ribbon therein with a portion of said ink ribbon extending between said extremes of said guide arms to expose said portion to the exterior of said cassette body for printing;

a pair of inclined surfaces formed in said bottom face of said cassette body, inclined with respect to said bottom face, and terminating in a positioning slit extending in a direction essentially perpendicular to the direction of said ink ribbon portion extending between said extremes of said guide arms and essentially parallel to said guide arms;

a fixing projection formed on each opposing side face of said cassette body; and a cassette supporting member for supporting said ink ribbon cassette, including:

a support member body and a pair of support arms extending from said support member body in a generally parallel configuration corresponding to the parallel configuration of said guide arms, each of said support arms having a support projection for engaging and supporting a corresponding guide arm, the support arm engaging and supporting one said guide arm further having a flat positioning protrusion formed to be received in and embraced by said slit and being guided thereto by said inclined surfaces; and engaging means for resiliently engaging said fixing projections, said engaging means including a pair of spring-biased fixing pawls disposed on opposing side edges of said support body, each for engaging a corresponding one of said fixing projections.

4. An ink ribbon cassette system according to claim 3, wherein said supporting member further includes:

an abutment member for positioning said rear face of said cassette body; and a spring member disposed adjacent said abutment member on said support member body, said engaging means urging said rear face of said cassette body into engagement with said abutment member and said spring member urging said cassette body away from said support member body to provide a biasing moment of said fixing projections about said engaging means, whereby said cassette is stably supported on said supporting member by coooperation of said engaging means and said fixing projections, said flat protrusion and said slit, and said rear face and said abutment member.

5. An ink ribbon cassette system according to claim 4, wherein said abutment member is formed with a notch and said rear face of said cassette body is formed with a positioning projection formed to be received in said notch.

6. An ink ribbon cassette system according to claim 3, wherein said ink ribbon cassette further comprises:

a ribbon feeding member disposed within said cassette body for driving said ink ribbon; and a positioning projection formed on said rear face of said cassette body, opposite one said guide arm; said positioning slit being provided in said one guide arm with said positioning slit, said ribbon feeding member and said positioning projection being arranged substantially in a straight line.

7. An ink ribbon cassette system according to claim 3, wherein each of said fixing projections has a substantially rectangular cross sectional shape in a plane perpendicular to the direction of projection thereof and includes a tapered surface at one corner thereof.

* * * * *

UNITED STATES PATENT AND TRADEMARK OFFICE

CERTIFICATE OF CORRECTION

PATENT NO. : 4,867,586

DATED : September 19, 1989

INVENTOR(S) : Noboru Shimoyama

It is certified that error appears in the above-identified patent and that said Letters Patent is hereby corrected as shown below:

COLUMN 1

Line 12, change "experior" to --exterior--.
Line 15, change "use" to --one-time use--.
Line 34, change "enablew" to --enable--.
Line 54, change "ane" to --and--.

COLUMN 3

Line 55, change "one-time ink ribbon" to --one-time use ink ribbon--.

COLUMN 4

Line 8, change "on end" to --one end--.
Line 34, change "cross sectional" to --cross-sectional--.

COLUMN 5

Line 23, change "coooperation" to --cooperation--.

UNITED STATES PATENT AND TRADEMARK OFFICE

CERTIFICATE OF CORRECTION

PATENT NO. : 4,867,586

DATED : September 19, 1989

INVENTOR(S) : Noboru Shimoyama

It is certified that error appears in the above-identified patent and that said Letters Patent is hereby corrected as shown below:

COLUMN 6

Line 20, change "cross sectional" to --cross-sectional--.

Signed and Sealed this

Eleventh Day of August, 1992

*Attest:*

DOUGLAS B. COMER

*Attesting Officer*

*Acting Commissioner of Patents and Trademarks*